US007766711B2

(12) United States Patent
Crumrine

(10) Patent No.: US 7,766,711 B2
(45) Date of Patent: Aug. 3, 2010

(54) HARDWARE-LESS WAKEBOARD BINDING COMPONENT AND ASSEMBLY AND METHOD OF MAKING ASSEMBLY

(75) Inventor: Scott Crumrine, Carlsbad, CA (US)

(73) Assignee: Motion Water Sports, Inc., Redmond, WA (US)

( * ) Notice: Subject to any disclaimer, the term of this patent is extended or adjusted under 35 U.S.C. 154(b) by 0 days.

(21) Appl. No.: 11/475,121

(22) Filed: Jun. 27, 2006

(65) Prior Publication Data

US 2006/0292943 A1 Dec. 28, 2006

Related U.S. Application Data

(60) Provisional application No. 60/693,791, filed on Jun. 27, 2005.

(51) Int. Cl.
*B63B 35/85* (2006.01)
*A63C 9/00* (2006.01)
*A63C 9/08* (2006.01)

(52) U.S. Cl. ..... 441/70

(58) Field of Classification Search ..... 114/39.19; 441/65, 70, 75; 280/14.22, 14.24
See application file for complete search history.

(56) References Cited

U.S. PATENT DOCUMENTS

| | | | | |
|---|---|---|---|---|
| 4,389,200 | A | 6/1983 | O'Brien | |
| 4,869,697 | A * | 9/1989 | Ackert et al. | 441/70 |
| 5,181,873 | A * | 1/1993 | Tolbert | 441/65 |
| 5,499,837 | A * | 3/1996 | Hale et al. | 280/607 |
| 5,875,566 | A * | 3/1999 | Bourdeau et al. | 36/12 |
| 6,266,899 | B1 * | 7/2001 | Borsoi et al. | 36/117.1 |
| 6,299,192 | B1 * | 10/2001 | Bryce | 280/613 |
| 6,729,641 | B2 * | 5/2004 | Okajima et al. | 280/613 |

FOREIGN PATENT DOCUMENTS

| | | | |
|---|---|---|---|
| EP | 865741 | A1 * | 9/1998 |
| JP | 11-4701 | | 1/1999 |
| JP | 2000-37203 | | 2/2000 |

* cited by examiner

*Primary Examiner*—Ajay Vasudeva
(74) *Attorney, Agent, or Firm*—Clark & Brody

(57) ABSTRACT

A wakeboard binding assembly includes a binding base and an outersole. The binding base is adapted to attach both to the wakeboard, and an upper of the binding. The outersole is designed to surround the periphery of the binding base and cover the area of attachment between the binding base and the binding upper. The attachment of the upper to the binding base eliminates the need to use hardware and fasteners for attachment of the upper to the wakeboard.

9 Claims, 4 Drawing Sheets

HARDWARE-LESS WAKEBOARD BINDING COMPONENT AND ASSEMBLY AND METHOD OF MAKING ASSEMBLY

This application claims priority under 35 USC 119(e) based on provisional patent application No. 60/693,791 filed on Jun. 27, 2005, which is herein incorporated by reference in its entirety.

FIELD OF THE INVENTION

The present invention is directed to a floatation device binding, and particularly to a wakeboard binding that does not require the conventional hardware for attachment to a wakeboard.

BACKGROUND ART

In the prior art, various types of bindings are used for floatation devices such as wakeboards. The bindings include various types of boot components to hold a user's foot in place during use. Typical components include heel and toe pieces, one piece boots, overlays, underlays, and the like.

Normally, the boot components are attached to the wakeboard using various types of hardware and fasteners. Referring to FIG. 1, one example of a hardware assembly for a wakeboard 1 is generally designated by the reference numeral 10. Boot components as a toe piece 3 and footbed 5 are illustrated. The toe piece is secured in place by a clamp 7 and fasteners 9, adapted to extend through the clamp and edges 11 of the toe piece to keep it in place. The clamp 7 can take any form, such as a one piece U-shape that would also facilitate attachment of a heel piece as well, or separate members situated on either side of the toe piece for attachment.

The current state of the art for securing the boot components to the wakeboard has been around for a long time, and is cumbersome, bulky, costly, and time consuming for assembly of the wakeboard binding. Thus, a need exists to provide improved ways to attach the boot components of a binding to a wakeboard.

The present invention solves this need by providing a hardware-less binding assembly that eliminates the need for complicated clamping and fastening systems.

SUMMARY OF THE INVENTION

A first object of the invention is an improved wakeboard binding assembly.

Another object of the invention is a wakeboard using the improved binding assembly.

A further object of the invention is a method of making the binding assembly.

Other objects and advantages will become apparent when reviewing the description below.

In satisfaction of the foregoing objects and advantages, the invention is an improvement in fluid floatation device bindings such as wakeboards.

One aspect of the invention is a binding base adapted for use with a fluid floatation device such as a wakeboard. The binding base includes means for attaching the binding base to the fluid floatation device. The attaching means could be openings in a bottom of the binding base to receive fasteners. The binding base is configured with a space that is adapted to receive a portion of the upper of the fluid floatation device binding and a periphery that is adapted to secure the upper of the fluid floatation device to the binding base.

The binding base can be combined with an outersole to form an assembly that is shaped to surround the periphery of the binding base and cover an area where the portion of the upper of the fluid floatation device binding is secured to the binding base. The outersole also provides an aesthetic appearance in that it can be colored, shaped and the like to make the overall binding more attractive to a user or potential purchaser. The upper is considered to be that part of the boot assembly of the binding, which receives the foot of the user. The upper can be made of one or various components depending on the style of the binding. For example, the upper could be a one piece boot, either open or closed toe, the combination of a toe piece and heel piece, the boot and/or toe and heel pieces in combination with an overlay or underlay, the footbed of a binding and the like.

The binding base can also be combined with the upper to form an assembly of the two, as well as means for attaching the upper to the periphery of the binding base. The outersole can also be made part of this assembly.

The means for attaching the upper to the binding base can include one or more of gluing, stitching, and mechanical fastening. When attaching the upper to the binding base, a portion or the entirety of the periphery of the binding base can be employed for attachment purposes.

The invention also entails a method of constructing the binding assembly wherein a binding having an upper is ultimately mounted to a surface of the fluid floatation device. According to the inventive method, the upper of the binding assembly is attached to the periphery of the binding base using one or more of stitching, gluing, and mechanical fastening. The area of attachment can then be covered to produce a pleasing and cosmetically acceptable look to the assembled binding assembly. Preferably, an outersole that is shaped to at least surround the periphery of the binding base and cover an area where the upper portion of the fluid floatation device is secured to the binding base. The outersole could envelop the binding base or merely surround its periphery.

While the invention can be used in any fluid floatation device that employs bindings using uppers, the invention is particularly adapted for wakeboard bindings so as to eliminate the hardware and fasteners commonly employed to secure the upper of the binding to the wakeboard.

DESCRIPTION OF THE PREFERRED EMBODIMENTS

The inventive binding assembly for a wakeboard offers significant advantages over the prior art binding assemblies. That is, the prior art binding assemblies that use cumbersome and awkward hardware arrangements are eliminated in favor of a simple binding assembly. The inventive assembly is lower cost, lighter weight, and provides a more narrow profile than the prior art arrangements. In addition, the exterior of the binding assembly can be provided with a cleaner, sleeker, and more cosmetically attractive look. This improved exterior appearance translates into an additional selling feature, thus enhancing the sales of the product.

Figure 1:
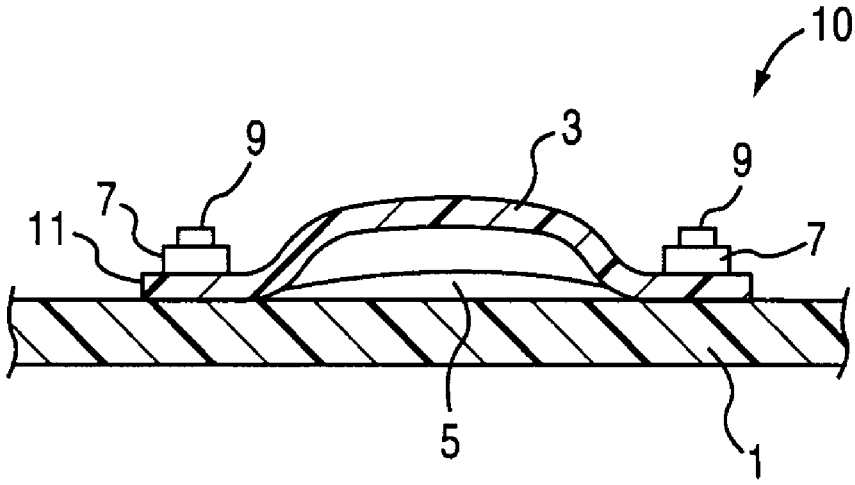
Fig.1 Prior Art
FIG. 1 is a sectional view of a prior art binding assembly.
Figure 6:
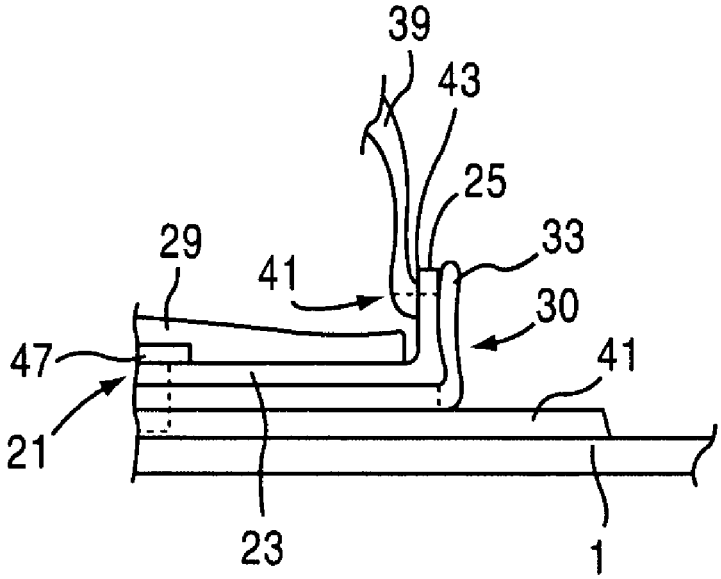
FIG. 6 is a sectional view of the attachment between the first and second components of FIGS. 2 and 3.
Figure 2:
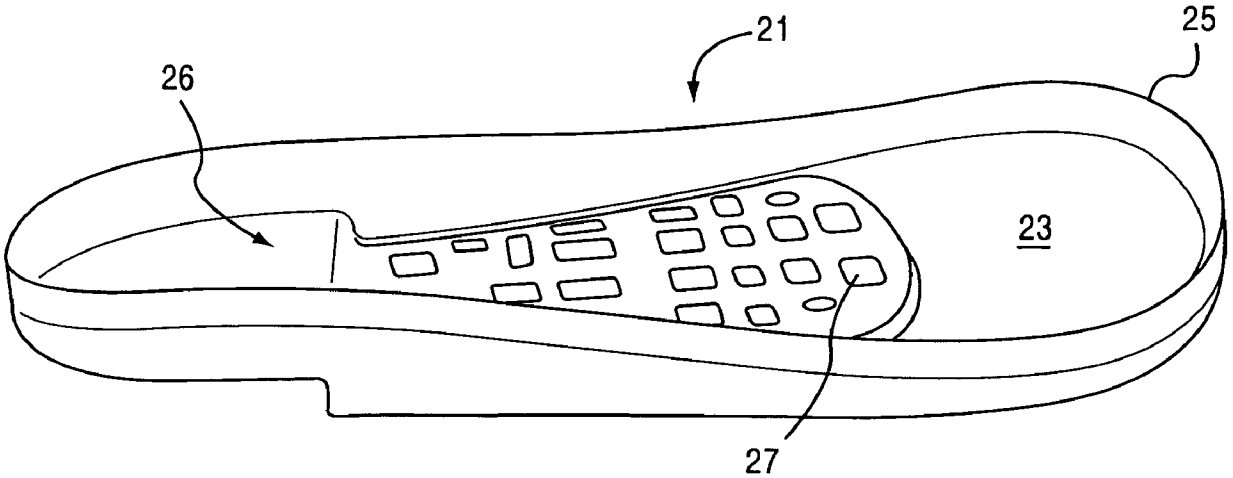
FIG. 2 is a perspective view of one component of one embodiment of the inventive binding assembly.
Figure 3:
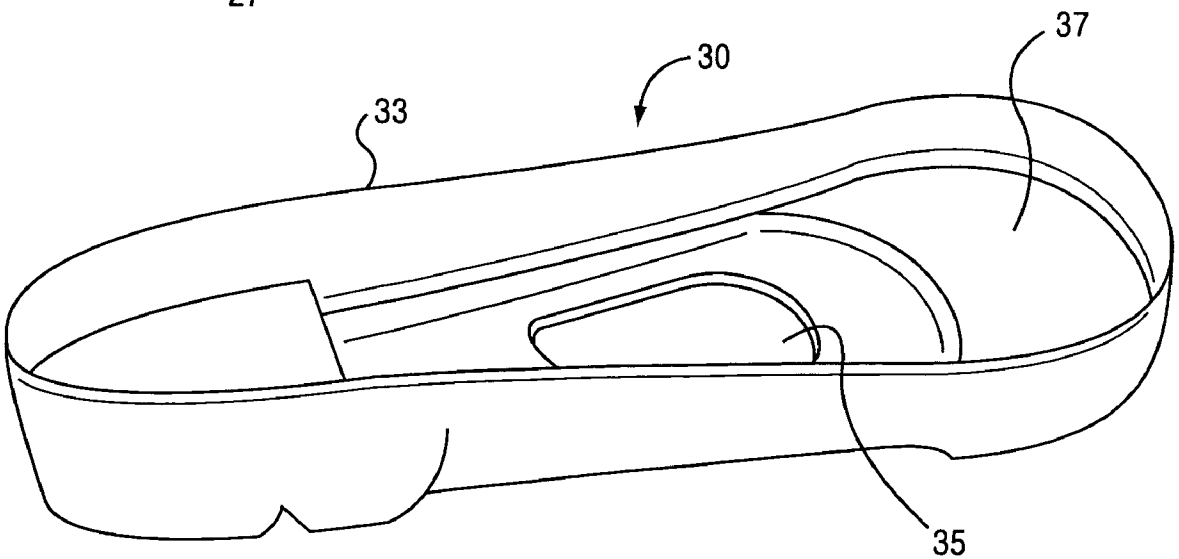
FIG. 3 is a perspective view of a second component of one embodiment of the inventive binding assembly.
Figure 4:
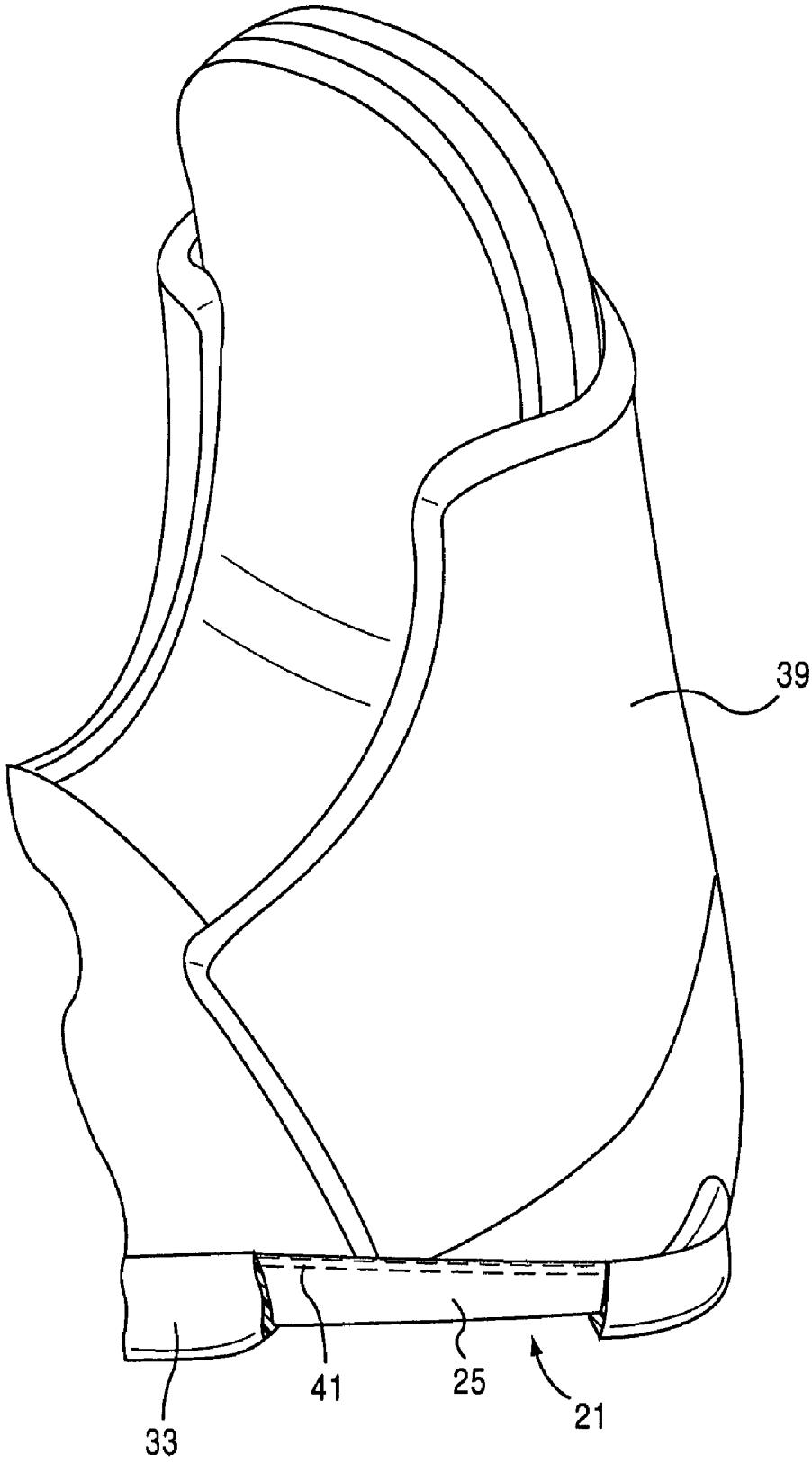
FIG. 4 is a partial view of an assembled binding, showing the attachment between the two binding assembly components of FIGS. 2 and 3.

Referring now to FIGS. 2 and 3, the separated components of the inventive binding assembly are shown. FIGS. 4 and 6 show the components in the assembled state.

FIG. 2 shows one component of the binding assembly as a binding base 21. The base 21 has a bottom 23 and side walls 25. The bottom 23 has openings 27 which allow the base 21 to be mounted onto a wakeboard, either directly or via an intermediate component such as a binding plate. The base bottom 23 and sidewalls 25 form a recess 26 that is configured to accept a footbed 29, see FIG. 6, as part of the binding assembly. It should be understood that the means for attaching the binding base 21 to a wakeboard can be any type depending the particulars of the binding being used. As stated above, the binding base 21 may be adapted to directly attach to the wakeboard, or attach to a binding plate assembly that may allow the binding to be adjusted with respect to the wakeboard. FIG. 6 as described below shows one example of an attachment.

Referring now to FIG. 3, an outersole 30 is depicted which also includes a bottom 31 and a sidewall 33. An opening 35 is shown in a central portion of the bottom to facilitate attachment of the binding base 21 to the wakeboard. The bottom 31 and sidewall 35 form a recess 37 that is sized to receive the binding base. The sidewall 33 is sized in height to cover the sidewall 23 of the binding base 21 for aesthetic purposes as detailed below. When used as shown in FIG. 3, the outersole both surrounds the periphery of the binding base but is also interposed between the base bottom and a surface of the wakeboard, either directly or indirectly.

Referring now to FIGS. 4 and 6, the binding assembly is shown in an assembled state, with a portion of the outersole sidewall 33 removed to show more detail. The assembly includes the binding base 21, the outersole 30, and a binding upper 39 in FIG. 4, and these same components mounted to a wakeboard 1 using a binding plate 41. Binding plates are well known to enhance the attachment of a wakeboard binding to a wakeboard, and a further description is not necessary for understanding of this aspect of the invention. In one mode, the binding plate 41 can allow the binding base 21 to be mounted to the wakeboard 1 in an adjustable fashion if made according to the teachings of U.S. Pat. No. 6,945,837 to Crumrine et al., herein incorporated by reference.

As shown in FIGS. 4 and 6, the binding upper 39 is attached to the sidewall 25 of the binding base using stitching 41 and an adhesive 43 interposed between the binding upper and sidewall 23. The means for attaching the binding base 21 to the binding upper 39 preferably includes both stitching and adhesives to ensure the integrity of the joint between the upper 39 and the binding base sidewall 23. However, any form of attachment can be employed as the means for attaching the binding base to the upper 39, including adhesives, mechanical fastening, stitching, or combinations thereof. Similarly, the outersole 30 can be attached to the binding base 21 in any known fashion, with a preferred method including the use of an adhesive placed between the outer surface of sidewall 25 of the binding base 21 and an inside surface of the sidewall 33 of the outersole 30. FIG. 6 is also representative of the attachment of the binding base 21 to the plate 41 using a fastener 47, although more fasteners could be employed.

It should be understood that the binding upper is intended to encompass any type of binding component that is intended to form an upper part of the binding that surrounds the user's foot. Examples of uppers include toe pieces, heel pieces, overlays, one piece boots, underlays, combinations thereof, and the like. Typically, some part of the upper is attached to the wakeboard or floatation device, but according to the invention, the upper is attached to the binding base, which is in turn secured to the water floatation device in some way.

Referring again to the use of stitching, the extent of the stitching along the sidewall 23 will vary depending on the type of upper being combined with the binding base 21. For example, for a closed toe upper, whether the upper is a one piece construction or combination of heel and toe piece, the stitching can extend around the entirety of the binding base 21 in order to ensure that the upper is adequately attached so that it does not become removed from the base 21. For an open toe upper, the stitching would extend along the sides and heel portion of the binding base 21 and upper. Any type of stitching pattern and/or any number of rows of stitching can be employed as part of the means for attaching the binding base to the upper to achieve the necessary pull strength of the joint. One preferred target pull strength for the attachment is 800 pounds, but this can be greater or less depending on the binding particulars and the type of floatation device being used. One preferred manner of stitching is the use of two rows.

In one method of making the binding assembly, the binding upper is provided, whether in the form of a single piece construction, the combination of components, e.g., an inner boot, overlay, toe and heel pieces, or any other known binding upper construction. Once the upper is provided, the appropriate end is stitched and glued or otherwise fastened to the sidewall 23 of the binding base 21 in a manner consistent with the shape of the upper. The binding base 21 is then inserted into the recess 35 of the outersole 30 so that the outersole 30 covers the attachment of the upper 39 and binding base sidewall 23. Then, the binding base 21 is attached to the wakeboard, either directly or indirectly via a plate assembly or the like.

A footbed can be used as well as part of the assembly process. Typically, the footbed can be glued or otherwise attached in the recess 26 of the binding base 21. When employing the outersole, the footbed is glued prior to attachment of the outersole, and the assembly is then attached to the wakeboard in any known fashion.

Figure 5:
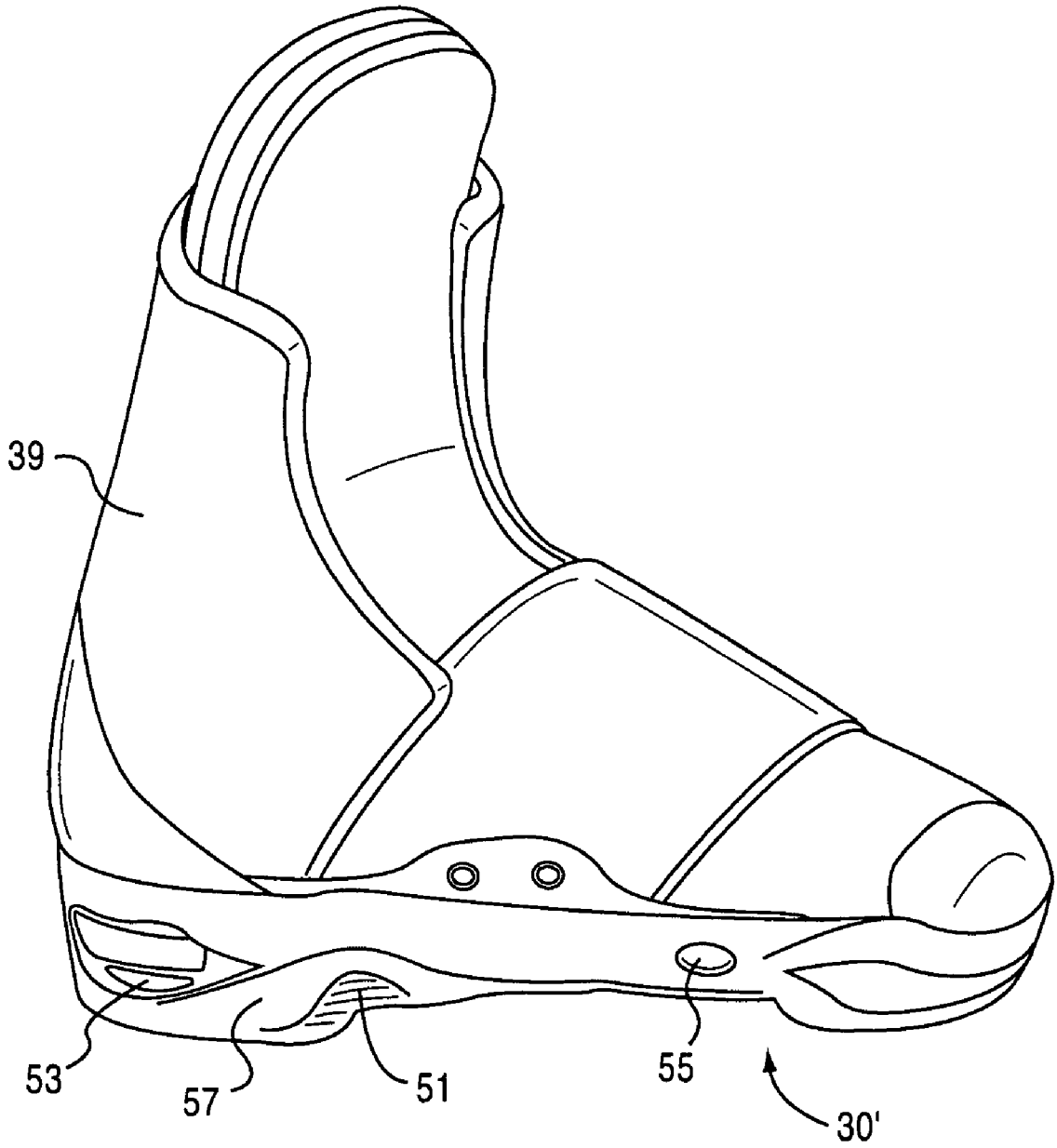
FIG. 5 shows another embodiment of the second component as part of a binding assembly.

While the outersole is shown as part of the preferred embodiment, it is an optional feature since it does not structurally maintain the integrity of the attachment between the binding base and upper. Thus, in certain instances, it may be desirable to only use the binding base to secure the upper of the binding, and leave the area of attachment between the binding base and upper exposed. However, the use of the outersole provides a more cosmetically pleasing binding. That is, the outersole can be made in various shapes and colors, and with various markings or logos so as to give the binding assembly a unique identity. In this regard, FIG. 5 shows another style of outersole designated as reference numeral 30'. This outersole includes features such as ridges 51, a recess 53, a logo 55, a protruding part 57, and the like to make it more cosmetically pleasing and identifiable.

While the outersole is shown with an opening in the bottom to allow for attachment of the binding base to the wakeboard, it could have other configurations to hide the attachment joint between the binding base and upper. For example, the outersole could take the form of just the sidewall 33, e.g., a strip that would surround the binding base and be devoid of a bottom that is positioned between the base and the wakeboard as shown in FIG. 6. Alternatively, the bottom of the outersole could be continuous with any fasteners used for attachment of the binding base to the wakeboard penetrating the material of the outersole rather than passing through an opening in the outersole bottom.

The binding base and outersole can be made of any material that would be appropriate for use in a water floatation device, including polymers, metals, composites, or combinations thereof. Preferably, the base binding is metal to provide the necessary pull strength, and the outersole is a polymer material allowing it to be molded or made into various shapes, colors, etc. A more preferred material for the binding base is a high strength glass-filled nylon since it combines strength, light weight, and the ability to be stitched through.

The invention is also advantageous in that airpacks or other conventional shoe cushioning devices or technology can be more easily utilized with the binding plate and upper attachment.

While the invention is particularly described for wakeboards, it is believed that the binding assembly could be adapted for any floatation device for a fluid such as water, or a solid such as snow, or sand. For purposes of this application, snow, sand and water are grouped together under the definition of a fluid when describing the type of floatation device adaptable for use with the invention.

As such, an invention has been disclosed in terms of preferred embodiments thereof which fulfills each and every one of the objects of the present invention as set forth above and provides a new and improved wakeboard binding assembly, and its method of assembly.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a wakeboard and wakeboard binding assembly wherein the binding assembly is attached to the wakeboard, the binding assembly having:

a binding base comprising a one piece structure with a bottom, a peripheral side wall extending upwardly from the bottom, with the bottom and the peripheral side wall forming a recess;

an upper of a binding for the wakeboard, the upper having a side wall portion;

means for removably attaching the binding base to the wakeboard, the means for removably attaching located on an underside of the binding base;

the recess adapted to receive a portion of the upper, and means for attaching the side wall portion of the upper to the peripheral wall of the binding base, wherein the means for attaching includes at least stitching through the side wall portion of the upper and through the peripheral wall of the binding base.

2. The assembly of claim 1, wherein the means for attaching includes gluing and stitching.

3. The assembly of claim 1, wherein at least a portion of the periphery of the upper is attached to the binding base.

4. The assembly of claim 3, wherein an entire portion of the periphery of the upper is attached to the binding base.

5. The assembly of claim 1, further comprising an outersole shaped to surround the peripheral wall of the binding base and cover the stitching securing the upper to the binding base.

6. In a method of constructing the binding assembly of claim 3, wherein the binding having the upper is mounted to a surface of the wakeboard comprising securing the upper to the binding base of the binding assembly of claim 3, the securing by at least stitching going through each of the upper and the binding base, and securing the binding base to the wakeboard through the underside of the binding base, such that the upper is attached to the wakeboard by the attachment of the binding base to the wakeboard.

7. The method of claim 6, wherein the binding base is secured to the wakeboard in a removable manner.

8. The method of claim 7, further comprising covering an exposed area of the stitching used for securing of the upper to the binding assembly.

9. The method of claim 8, wherein an outersole shaped to surround at least the periphery of the binding base is used to cover the exposed area where the upper portion of the wakeboard is secured to the binding base.

* * * * *